US007669669B2

(12) United States Patent
Downton et al.

(10) Patent No.: US 7,669,669 B2
(45) Date of Patent: Mar. 2, 2010

(54) TOOL FACE SENSOR METHOD

(75) Inventors: Geoff Downton, Minchinhampton (GB); Peter Hornblower, Bath (GB); Martin Bayliss, Stroud (GB); Edward Richards, Stratford-Upon-Avon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 440 days.

(21) Appl. No.: 11/830,047

(22) Filed: Jul. 30, 2007

(65) Prior Publication Data

US 2009/0032302 A1 Feb. 5, 2009

(51) Int. Cl.
*E21B 47/024* (2006.01)

(52) U.S. Cl. ..... 175/45; 175/61; 166/255.2

(58) Field of Classification Search ..... 175/45, 175/48, 61; 166/255.2; 702/9; 73/152.43
See application file for complete search history.

(56) References Cited

U.S. PATENT DOCUMENTS

| | | | |
|---|---|---|---|
| 3,743,034 | A | 7/1973 | Bradley |
| 4,351,116 | A | 9/1982 | Scott, Jr. |
| 5,113,953 | A | 5/1992 | Noble |
| 5,259,468 | A | 11/1993 | Warren et al. |
| 5,265,682 | A | 11/1993 | Russell et al. |
| 5,520,255 | A | 5/1996 | Barr et al. |
| 5,553,678 | A | 9/1996 | Barr et al. |
| 5,553,679 | A | 9/1996 | Thorp |
| 5,582,259 | A | 12/1996 | Barr |
| 5,603,385 | A | 2/1997 | Colebrook |
| 5,673,763 | A | 10/1997 | Thorp |
| 5,685,379 | A | 11/1997 | Barr et al. |
| 5,695,015 | A | 12/1997 | Barr et al. |
| 5,706,905 | A | 1/1998 | Barr |
| 5,778,992 | A | 7/1998 | Fuller |
| 5,803,185 | A | 9/1998 | Barr et al. |
| 5,971,085 | A | 10/1999 | Colebrook |
| 6,089,332 | A | 7/2000 | Barr et al. |
| 6,092,610 | A | 7/2000 | Kosmala et al. |
| 6,158,529 | A | 12/2000 | Dorel |
| 6,234,259 | B1 | 5/2001 | Kuckes et al. |
| 6,244,361 | B1 | 6/2001 | Comeau et al. |
| 6,364,034 | B1 | 4/2002 | Schoeffler |
| 6,394,193 | B1 | 5/2002 | Askew |
| 7,188,685 | B2 | 3/2007 | Downton et al. |
| 2001/0052428 | A1 | 12/2001 | Larronde et al. |
| 2002/0011359 | A1 | 1/2002 | Webb et al. |
| 2004/0084219 | A1 | 5/2004 | Western |
| 2006/0157281 | A1 | 7/2006 | Downton |
| 2008/0142269 | A1 | 6/2008 | Richards et al. |

*Primary Examiner*—Jennifer H Gay
*Assistant Examiner*—David Andrews
(74) *Attorney, Agent, or Firm*—Vincent Loccisano; Brigitte L. Echols

(57) ABSTRACT

Exhaust pressure from at least one actuator (34,36) which can tilt joint 6 of a bottom hole assembly 4 can be utilized to determine the direction 26 tiltable joint 6 is pointing (e.g., orientation, angular displacement, and/or inclination and azimuth). In one embodiment, a known exhaust pressure can be correlated to a known orientation and/or angular displacement, and the measured exhaust pressure can be compared to the known exhaust pressure to determine the orientation and/or angular displacement. In another embodiment, the flow rate of fluid exhausted from an actuator (34,36) can be derived from the exhaust pressure. The exhaust flow rate can then be used to calculate the state of actuation, which can allow determination of the angular displacement of the tiltable joint 6. Orientation and/or angular displacement with respect to the bottom hole assembly 4 can be resolved into an inclination and azimuth with respect to a formation 14.

18 Claims, 1 Drawing Sheet

TOOL FACE SENSOR METHOD

BACKGROUND

The invention relates generally to a method of determining the direction a tool face points; more particularly, to determining the orientation and/or angular displacement of a tiltable joint of a bottom hole assembly.

Steerable systems for use drilling boreholes in a formation, for example, for subsequent use in the extraction of oil or gas, are well known. One steerable system is a rotary steerable drilling system, which can include substantially continuous rotation of the drill string. Rotary steerable systems can be classified as "point-the-bit" systems, "push-the-bit" systems, or even a hybrid system, such as described in U.S. Pat. No. 7,188,685 entitled Hybrid Rotary Steerable System. Examples of point-the-bit type rotary steerable systems and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953, all herein incorporated by reference. Examples of push-the-bit type rotary steerable systems and how they operate are described in U.S. Pat. Nos. 5,265,682, 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Regardless of the type of steerable system, a bottom hole assembly of a drilling system can include a tiltable joint. This joint can be used, for example, to aim a tool face in a desired direction which can control the direction in which the borehole propagates. The movement of the joint relative to the bottom hole assembly, e.g., the direction in which the tiltable joint points, is primarily controlled by the force applied by steering actuators, which can be drilling fluid powered. These forces can be referenced with respect to a formation fixed frame work, instead of with respect to the rotating bottom hole assembly, and so the direction in which the actuators apply force to point the tiltable joint can be inertially referenced.

Unknown forces, for example, bottom hole dynamics, bending, frictional contact of the bottom hole assembly with the formation, drill bit reaction forces, joint friction, weight on bit, etc., act to perturb the direction in which the tiltable joint, e.g., the tool face, points. It can be desirable to determine the direction a tool face points, or more particularly, to determine the orientation and/or angular displacement of a tiltable joint of a bottom hole assembly.

The orientation and/or angular displacement of the tiltable joint with respect to the bottom hole assembly can be directly measured by a resolver or angular potentiometer on the tiltable joint and/or gap-sensors measuring relative motions in two non-collinear planes (inductive, capacity, etc.) between tiltable joint and bottom hole assembly. However inclusion of such devices can be impossible or undesirable, e.g., tight tolerances.

SUMMARY OF THE INVENTION

In one embodiment, a method of determining an orientation of a tiltable joint connected to a bottom hole assembly can include providing a plurality of radially disposed actuators driven by a fluid to tilt the tiltable joint, correlating a known orientation of the tiltable joint with respect to the bottom hole assembly with a set of known exhaust pressures of the plurality of radially disposed actuators, measuring an exhaust pressure of the fluid from at least one of the plurality of radially disposed actuators to produce a set of exhaust pressures, and comparing the set of exhaust pressures and the correlated set of known exhaust pressures to determine the orientation of the tiltable joint with respect to the bottom hole assembly. The method can include providing an inclination and azimuth of the bottom hole assembly with respect to a formation, and resolving an inclination and azimuth of the tiltable joint with respect to the formation via the orientation of the tiltable joint with respect to the bottom hole assembly and the inclination and azimuth of the bottom hole assembly with respect to the formation.

The method can include supplying the fluid from a bore of the bottom hole assembly. The fluid can be a drilling fluid. The method can include measuring at least one of a fluid supply pressure and a fluid return pressure locally to the plurality of radially disposed actuators, and removing any pressure loss associated with the at least one of the fluid supply pressure and the fluid return pressure from the exhaust pressure to produce the set of exhaust pressures. The set of known exhaust pressures can be a set of known peak exhaust pressures.

In another embodiment, a method of determining an angular displacement of a tiltable joint connected to a bottom hole assembly can include providing a plurality of radially disposed actuators driven by a fluid to tilt the tiltable joint, correlating a known angular displacement of the tiltable joint with respect to the bottom hole assembly with a set of known exhaust pressures of the plurality of radially disposed actuators, measuring an exhaust pressure of the fluid from at least one of the plurality of radially disposed actuators to produce a set of exhaust pressures, and comparing the set of exhaust pressures and the correlated set of known exhaust pressures to determine the angular displacement of the tiltable joint with respect to the bottom hole assembly.

The method can include providing an inclination and azimuth of the bottom hole assembly with respect to a formation, and resolving an inclination and azimuth of the tiltable joint with respect to the formation via the angular displacement of the tiltable joint with respect to the bottom hole assembly and the inclination and azimuth of the bottom hole assembly with respect to the formation. The method can include supplying the fluid from a bore of the bottom hole assembly. The fluid can be a drilling fluid. The method can include measuring at least one of a fluid supply pressure and a fluid return pressure locally to the plurality of radially disposed actuators, and removing any pressure loss associated with the at least one of the fluid supply pressure and the fluid return pressure from the exhaust pressure to produce the set of exhaust pressures. The set of known exhaust pressures can be a set of known peak exhaust pressures.

In yet another embodiment, a method of determining an angular displacement of a tiltable joint connected to a bottom hole assembly can include providing a plurality of radially disposed actuators driven by a fluid to tilt the tiltable joint, measuring an exhaust pressure of the fluid from at least one of the plurality of radially disposed actuators to produce a set of exhaust pressures, deriving a set of exhaust flow rates from the set of exhaust pressures, calculating a state of actuation data set for the plurality of radially disposed actuators from the set of exhaust flow rates, and determining the angular displacement of the tiltable joint with respect to the bottom hole assembly from the state of actuation data set of the plurality of radially disposed actuators.

The step of calculating the state of actuation data set can include integrating the set of exhaust flow rates over a time interval. The step of calculating the state of actuation data set can include integrating the set of exhaust flow rates over a time interval to create a set of volumetric data, correlating a known volume of discharged fluid with a known actuator displacement, and generating the state of actuation data set via the set of volumetric data and the known volume of discharged fluid correlated with the known actuator displacement. The method can include calculating a rate of angular displacement change from the angular displacement.

The method can include providing an inclination and azimuth of the bottom hole assembly with respect to a formation, and resolving an inclination and azimuth of the tiltable joint with respect to the formation via the angular displacement of the tiltable joint with respect to the bottom hole assembly and the inclination and azimuth of the bottom hole assembly with respect to the formation. The method can include supplying the fluid from a bore of the bottom hole assembly, wherein the fluid is a drilling fluid. The method can include measuring at least one of a fluid supply pressure and a fluid return pressure locally to the plurality of radially disposed actuators, and removing any pressure loss associated with the at least one of the fluid supply pressure and the fluid return pressure from the exhaust pressure to produce the set of exhaust pressures. The set of known exhaust pressures can be a set of known peak exhaust pressures.

DETAILED DESCRIPTION OF THE INVENTION

The invention relates generally to a method of determining the direction a tool face points; or more particularly, of determining the orientation and/or angular displacement of a tiltable joint of a bottom hole assembly. As used herein, the term orientation refers to the position in relation to a specific place or object, for example, the direction an object is skewed with respect to a place or another object. The term angular displacement refers to the position in relation to a specific place or object (i.e., orientation) and the magnitude of skew therebetween, for example, the numerical degree an object is skewed with respect to another object.

Figure 1:
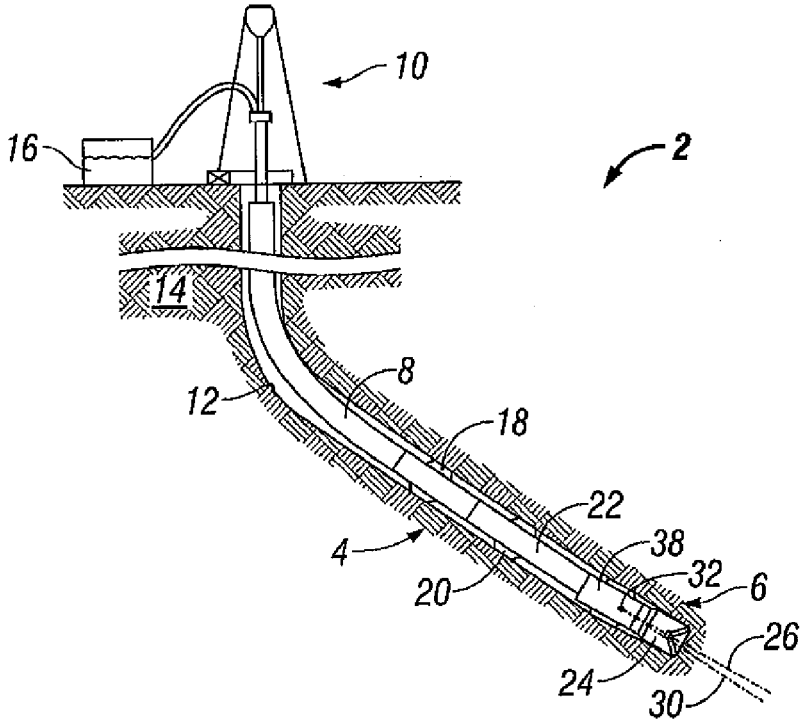
FIG. 1 is a schematic cross-sectional view of a rotary steerable system having a bottom hole assembly with a tiltable joint, according to one embodiment of the invention.
Figure 2:
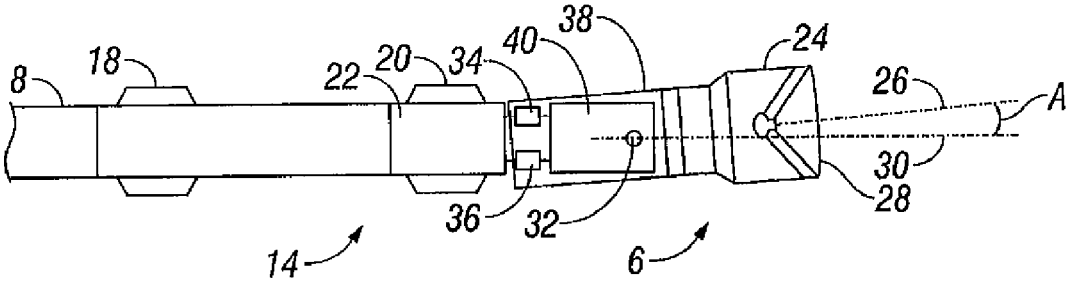
FIG. 2 is a schematic side view of the bottom hole assembly with a tiltable joint of FIG. 1.

FIGS. 1-2 describe one specific embodiment which can utilize the methods of the invention, however the methods are not so limited. FIG. 1 is a schematic cross-sectional view of a rotary steerable system 2 having a bottom hole assembly 4 with a tiltable joint 6, according to one embodiment of the invention. FIG. 2 is a schematic side view of the tiltable joint 6 of the bottom hole assembly 4 of FIG. 1. The bottom hole assembly (BHA) in FIG. 1, generally indicated as 4, is connected to the end of the tubular drill string 8 which can be rotatably driven by a drilling rig 10 at the surface to drill a borehole 12 in a formation 14. In addition to providing motive force for rotating the drill string 8, drilling rig 10 can supply a drilling fluid 16, e.g., under pressure, through the tubular drill string 8 to the bottom hole assembly 4. In order to achieve directional control while drilling, components of the bottom hole assembly 4 can include a tiltable joint 6 and/or one or more drill collar stabilizers (18,20), for example, of a rotary steerable system 2. Upper section 22 of bottom hole assembly 4 can house the electronics and/or other devices for control of the rotary steerable system 2.

Tiltable joint 6 of bottom hole assembly 4 shown in FIGS. 1-2 includes a drill bit 24 on a distal end. Drill bit 24 can be any kind known in the art. FIG. 2 illustrates the general direction 26 in which tool face 28 points in the current state of actuation, with the general direction 26 (e.g., central axis) of tool face 28 skewed from the central axis 30 of the bottom hole assembly 4 by a magnitude of skew A. In use, a tiltable joint 6 of a bottom hole assembly can allow the tool face 28 to be skewed from the central axis 30 of bottom hole assembly 4, e.g., such that the bit axis direction 26 of drill bit 24 defines the direction of wellbore 12 creation.

Tiltable joint 6 of bottom hole assembly 4 in this embodiment in FIGS. 1-2 includes a swivel 32, which can be a universal joint. The swivel 32 itself can transmit torque from a mud motor or the drill string 8 to the drill bit 24, or the torque can be separately transmitted via other arrangements. Suitable torque transmitting arrangements can include many well-known devices such as splined couplings, gearing arrangements, universal joints, and recirculating ball arrangements. In one embodiment, swivel 32 can provide a 360 degree pivot point for the tiltable joint 6. Swivel 32 can be a two degree of freedom joint. As used herein, tiltable joint refers to any apparatus for variably skewing one end relative to another. Non-limiting examples of tilting joints include a tilting head drill bit and a tilting sleeve, e.g., as described in U.S. Pat. No. 7,188,685, incorporated by reference herein.

Force to tilt the tiltable joint 6 with respect to the bottom hole assembly 4 can be provided by one or more actuators (34,36), as are known in the art. An actuator (34,36) can be motively driven by a fluid, for example, drilling fluid 16. A hydraulic actuator can include a dump valve actuator, for example, the bi-stable actuator and drilling system including same as described in U.S. patent application Ser. No. 11/609,996 incorporated by reference herein. An actuator (34,36) can include a cylinder and piston driven by a motive fluid.

In the view of the embodiment in FIG. 2, two actuators (34,36) are shown; however any number of actuators can be utilized to achieve a desired level of control over the tilting, for example. The current embodiment includes a sleeve 38 disposed on a mandrel 40 of the bottom hole assembly 4 by swivel 32. Sleeve 38 can be intermittently displaced by one or more actuators (34,36) about the swivel 32 with respect to the bottom hole assembly 4, for example, to actively maintain the general direction 26 in which tool face 28 points in a particular direction while the whole assembly can be rotated at drill sting 8 rate of rotation. The term actively tilted is meant to differentiate how a rotary steerable system 2 can be dynamically oriented as compared to known fixed displacement units. Actively tilted refers to a rotary steerable system 2 having no set fixed orientation (e.g., direction tool face points) and/or angular displacement (amount the tool face points in a direction). Orientation and/or angular displacement can vary dynamically as the rotary steerable system 2 is operated.

Ascertaining the orientation and/or angular displacement of the tool face 28 with respect to the bottom hole assembly 4 and/or formation 14 can be desired. For example, it may be desired to actively maintain tool face 28 in a geostationary orientation. In the embodiment in FIGS. 1-2, the position of the tool face 28 of the drill bit 24 relative to the bottom hole assembly 4 is primarily controlled by tilting the sleeve 38 having the drill bit 24 attached to a distal end thereof, via actuators (34,36). Actuators (34,36) can be sequentially actuated as the bottom hole assembly 4 rotates, so that the tilt of the drill bit 24 is actively maintained in the desired direction with respect to the formation 14 being drilled. Alternately or additionally, the actuators (34,36) can be intermittently actuated in a random manner, or in a directionally-weighted semi-random manner to provide for less aggressive steering, as the bottom hole assembly 4 rotates. There are also events during drilling when it can be desirable to activate a combination, all, or none of the actuators (34,36) simultaneously.

In a rotary steerable system 2, the drill string 8 can be constantly rotated, and thus steering the creation of the borehole 12 in the formation 14 can create a need to reference the orientation and/or angular displacement of the tool face 28 or other device attached to the tiltable joint 6 with respect to a formation 14 fixed framework, as opposed to with a bottom hole assembly 4 fixed framework. In the illustrated embodiment, a formation fixed framework can allow the direction in which the sleeve 38 is pushed, and therefore points, to be inertially referenced. Orientation can be referenced relative to the bottom hole assembly 4, for example, with respect to a fixed point on the bottom hole assembly 4. The distal end of the bottom hole assembly 4 can define a coordinate system with 0-360 degrees representing the orientation of skew with respect to a fixed point of the bottom hole assembly 4. Angular displacement can include the orientation (e.g., radial displacement) as well as the magnitude of axial skew in that orientation, for example, the axial skew between the tiltable joint 6 axis 26 and the central axis 30 of bottom hole assembly 4 shown in FIG. 2 as reference character A. Orientation describes the direction the tiltable joint is skewed relative to some fixed point (e.g., bottom hole assembly 4), while angular displacement includes the magnitude (e.g., reference character A) of axial skew in that orientation.

Rotary steerable drilling can include selective activation of appropriate actuator(s) during rotation of the bottom hole assembly 4 to achieve a desired movement of bit 24 with respect to the formation 14, e.g., to form a curve or dog leg in borehole 12 or reach a desired location in the formation 14. A sensor method to determine orientation and/or angular displacement of a tiltable joint 6, with respect to a bottom hole assembly 4 that said tiltable joint 6 is attached to and/or with respect to a formation 14, is disclosed herein.

An actuator (34,36) can include, but is not limited to, a fluid pressure system, a bellows, or a cylinder having a moveable piston to provide the force to tilt the tiltable joint 6. An actuator can include any means for converting hydraulic force into mechanical movement. A fluid, e.g., drilling fluid, can provide the force to drive the fluid pressure system of the actuator, e.g., bellows, piston, etc., said driving force tilting the tiltable joint 6.

Figure 3:
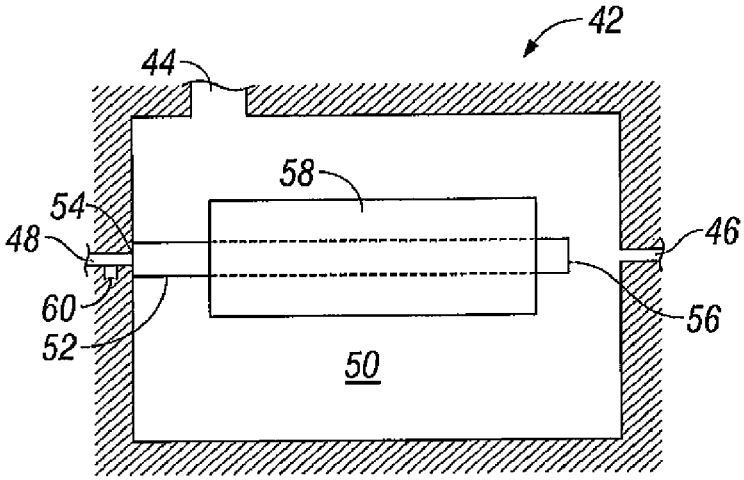
FIG. 3 is a schematic cross-sectional view of an actuator, according to one embodiment of the invention.

In the embodiment in FIGS. 1-2, a plurality of actuators (34,36) are radially disposed to allow radial deflection, i.e., steering, of the drill bit 24, relative to the bottom hole assembly 4. The number of actuators included is design dependent, and can include 1, 2, 3, 4, 5, 6, 7, 8, 9, 10, 20, 50, etc., to provide the desired level of control over the tilting of the tiltable joint 6. An actuator (34,36) can include a dump valve 42, for example, as shown in FIG. 3. A dump valve 42 can allow retraction of the actuator by release of fluid therefrom. In one embodiment, actuators are pushed into full extension with the sleeve 38 in their drive state and the subsequent movement of the sleeve 38 during the dump state is to push the actuator in, and thus the volumetric displacement of fluid will reflect actuator movement.

Dump valve 42 in the embodiment in FIG. 3 includes an inlet 44 to which fluid is supplied, for example, drilling fluid 16 supplied through a bore in bottom hole assembly 4 in communication with the bore of drill string 8. Dump valve 42 in FIG. 3 includes a first outlet 46 in communication with an actuator (e.g., fluid pressure system, a bellows, or a cylinder having a moveable piston) with which the dump valve 42 is associated. A second outlet 48 of the dump valve 42 can communicate with a lower pressure area, for example, the bore of the bottom hole assembly 4 and/or the annulus of the borehole 12 through a flow passage. The inlet 44 and first and second outlets (46,48) all can communicate with a chamber 50 formed in the dump valve 42. Located within the chamber 50 is a valve member 52, the valve member 52 being guided for reciprocating movement between a first position in which one end 56 of the valve member 52 engages a seating associated with the first outlet 46, closing the first outlet 46, with fluid being able to flow from the inlet 44 to the chamber 50 and through the second outlet 48 with the valve member 52 in this position; and a second position in which the opposing end 54 of the valve member 52 engages a seating associated with the second outlet 48, closing the second outlet 48 while permitting fluid to flow from the inlet 44 through the chamber 50 to the first outlet 46. Valve member 52 can also be in a central position where neither outlets (46,48) are closed. FIG. 3 illustrates the dump valve 42 with the valve member 52 in its second position, i.e., allowing fluid into an actuator (e.g., piston, bellows, etc.). An electromagnetic or mechanical actuator arrangement 58 can be provided to drive the valve member 52. Once the valve member 52 is moved to its first position, it will be appreciated that the valve member 52 closes the first outlet 46 and instead communication is established between the chamber 50 and the second outlet 48. As communication is broken between the chamber 50 and the first outlet 46, it will be appreciated that the fluid pressure within the associated actuator (e.g., cylinder, bellows, etc.) can fall, fluid escaping through an exhaust outlet (e.g., the second outlet 48 or a separate exhaust outlet), thus enabling the actuator bellows, piston, etc. to return to a retracted condition.

Dump valve 42 can switch the mechanical actuator means (e.g., piston, bellows, etc.) between a high pressure fluid source (e.g., in the "drive" state) and to a low pressure sink (e.g., in the "dump" state). Dump valve 42 can be used in a closed loop system, or an open loop system, for example, using the drilling fluid 16 as the motive fluid to drive the actuator. In the dump state, fluid can be forced to move out of the piston, bellows, etc. of the actuator (34,36) according to the movement (e.g., retraction) of the piston, bellows, etc.

Actuators (34,36) can be selectively activated to steer the tool in a desired direction, typically referenced relative to the formation 14. In the current embodiment, as the direction 26 of tool face 28 generally determines the direction of borehole 12 propagation, it can be desirable to determine the direction 26 of tool face 28, or other device attached via a tiltable joint 6. For example, a monitoring or control system governing the activation of the actuators (34,36) can utilize the direction 26 of tool face 28 relative to the bottom hole assembly 4 and/or formation 14.

Specifically, determining the orientation and/or angular displacement can be desired. For example, the orientation of the tiltable joint 6 with respect to the bottom hole assembly 4 can be determined. Additionally or alternatively, the angular displacement, which includes the orientation and the magnitude of skew, can be determined. For example, the angular displacement of the tiltable joint 6 with respect to the bottom hole assembly 4 can be determined.

As opposed to mechanically measuring the direction 26 a tiltable joint 6 points, a feature of the actuators (34,36) can be utilized to function as a directional sensor. For example, the pressure of the actuation fluid during the dump state, i.e., the exhaust pressure, can be useful in determining the direction 26 a tiltable joint 6 points. A pressure sensor 60, for example, as shown in FIG. 3, can be in communication with the exhaust pressure of the actuator (34,36). One way in which the incorporation of a pressure sensor 60 can involve minimal change is to use the same wiring as the dump valve 42 for both power and signal from the pressure sensor 60.

Exhaust pressure of the dumped actuation fluid can be employed in a number of embodiments to determine the direction a tiltable joint 6 points. The relationship between exhaust pressure and the movement of the actuator (34, 36) can be ascertained. More particularly, in one embodiment, the exhaust pressure from an actuator(s) (34, 36) can be used to derive a flow rate of fluid from the actuator (34,36). Bernoulli's equation, for compressible and/or incompressible flow, can be used to derive flow rate from the exhaust pressure, as known to one of ordinary skill in the art. That is, in this embodiment it is possible to measure the pressure, already knowing what the density is to determine the volume flow rate. Measuring the inlet pressure could be another variant of this as the pressure variation appears on the inlet flowrate as well as the out let flow. The inlet flow could be a single sensor for all pads which is correlated to the pad opening sequence to determine which piston is being opened. For example, the flow of fluid into an actuator can be caused by a pressure differential, e.g., between an annulus of the borehole 12 and an actuator (34,36). Pressure differential, fluid density, and/or discharge coefficients can be known and thus flow rate can be derived. Flow rate can be equal to the area multiplied by the velocity of the fluid. Flow rate can be integrated over a time interval to provide a time history of the motion of the actuator, e.g., a piston moving in a cylinder. The integral of the flow rate is the volume of fluid exhausted from the actuator (34,36) over that interval. As the volume of exhausted fluid corresponding to a level of actuation can be known (e.g., total volume of the actuator), the movement of an actuator can be calculated from this set of volumetric data. For example, a known volume of fluid discharged from an actuator can correlate to a known actuator displacement. Correlating can include disposing the tiltable joint 6, or more particularly, the actuator(s) thereof, into a desired orientation and/or angular displacement and measuring the corresponding exhaust pressure or volume of discharged fluid created by the disposing step. The movement of the actuators can be combined to form a state of actuation data set.

With the state of actuation (e.g., movement of the actuators) known, the corresponding movement of the tiltable joint 6 can be calculated, for example, as the mechanical relationship of actuator(s) and tiltable joint 6 can be known. Movement of the tiltable joint 6, or more particularly the deflectable portion thereof, can be referenced as the orientation and/or angular displacement relative to the bottom hole assembly 4 and/or formation 14. Orientation can be desired, for example, when the actuators are not variable, e.g., only achieving a maximum or minimum deflection of the tiltable joint 6. In one embodiment, the orientation can be in the form of a radial direction in which the tiltable joint 6 is skewed relative to the bottom hole assembly 4. The use of orientation can be desirable when determining the magnitude of skew is not desired. For example, when the tiltable joint 6 is capable of always forcing the joint into its maximum level of deflection, we know skew angle A and with the orientation can resolve the direction the tool face 28 points (e.g., inclination and azimuth) with respect to the formation 14.

Pressure sensor(s) 60 can also be utilized to determine the orientation and/or angular displacement of a tiltable joint 6 without integrating a set of exhaust flow rates. In one embodiment, a known orientation and/or angular displacement of the tiltable joint 6 can be correlated to a set of known exhaust pressures. The known exhaust pressure can be the peak exhaust pressure of fluid discharged from an actuator, e.g., in the dump state. A set of known exhaust pressures corresponding to a known orientation and/or angular displacement can be ascertained before using the tiltable joint within a formation 14. A measured exhaust pressure(s) can then be compared to the set of known exhaust pressure(s) to provide a corresponding orientation for that measured exhaust pressure. In such an embodiment, the corresponding orientation is the orientation at the measured exhaust pressure.

As the actuators can be disposed radially, e.g., disposed circumferentially about the axis 30 of the bottom hole assembly 4, the exhaust pressure from the actuators can be utilized for determining the orientation and/or angular displacement of the tiltable joint 6 with respect to the bottom hole assembly 4. In one embodiment, the peak exhaust pressure is caused by the pressure required to overcome the flow restriction when the fluid is exhausted as the actuator, e.g., a piston in cylinder, bellows, etc., is retracted. By measuring this peak exhaust pressure and comparing it to a known peak exhaust pressure corresponding to a known orientation and/or angular displacement of the tiltable joint 6, the orientation and/or angular displacement of the tiltable joint 6 corresponding to the measured peak exhaust pressure can be determined.

In one embodiment, the peak exhaust pressure can be referenced to the actuation signal of the dump valve 42 to determine the position (e.g., orientation and/or angular displacement) of the tiltable joint 4. If the tiltable joint 6 is exactly at the firing angle requested, then the tiltable joint 6 and the peak in exhaust pressure during the dump state are 180 degrees out of phase in that embodiment. If the tiltable joint 6 is at a different position, the peak exhaust pressure would be at a different position with respect to the firing angle. Angular displacement can further be used to determine a rate of angular displacement over a time interval.

Regardless of the method, exhaust pressure measurements can be further manipulated for accuracy. Referring again to the embodiment in FIG. 3, raw exhaust pressure is returned by pressure sensor 60. Exhaust pressure can be dependant on the pressure before and after the exhaust port (e.g., fluid supply and fluid return pressure). The fluid supply pressure (e.g., at port 44) and/or the fluid return pressure (e.g., downstream from second outlet 48), can be measured and removed from the exhaust pressure measured by pressure sensor 60. Fluid return pressure can be the pressure in the annulus between the bottom hole assembly 4 and the borehole 12. Such methods can also be used if a shock to the tiltable joint 6 causes a spike in the actuator exhaust pressure (e.g., piston in cylinder, bellows, etc.) that is measurable even with the dump valve 42 energized in a drive state.

After determining the direction (e.g., orientation and/or angular displacement) the tiltable joint 6 is pointing relative to the bottom hole assembly 4, the direction relative to the formation 14 can be determined, or more specifically, the inclination and azimuth of the tiltable joint 6 relative to the formation. This can be desirable when the bottom hole assembly 4 is rotated, for example, as in rotary steerable drilling. Tiltable joint 6 can be nutating with respect to the axis 30 of the bottom hole assembly 4 during use as the bottom hole assembly 2 is also rotating.

The inclination and azimuth of the tiltable joint 6, for example, that of the tool face 28, can be determined by providing an inclination and azimuth of the bottom hole assembly 4. One non-limiting way of providing inclination and azimuth data is to place the appropriate measuring devices in the bottom hole assembly 4, as known in the art. The orientation and/or angular displacement of the tiltable joint 6 with respect to the bottom hole assembly 4 can be used to resolve the inclination and azimuth of the tiltable joint 6 with respect to the formation 14. In one embodiment, the sleeve can extend between zero deflection (e.g., coaxial with the axis 30 of the bottom hole assembly 4, to a maximum deflection A, as is shown in FIG. 2. The orientation (e.g., which radial direction the tiltable joint 6 is pointing) determined can be utilized to resolve the inclination and azimuth of the tiltable joint 6 with respect to the formation 14. Resolving can include geometrical calculations, as are known in the art. The direction the tiltable joint 6 is pointing (e.g., orientation, angular displacement, and/or inclination and azimuth) can be calculated in real-time.

The amplitude of the pressure signal can be dependent on fluid, properties, i.e., the drilling fluid; fortunately in an embodiment when all actuators (34,36) receive the same fluid, the orientation can be determined even if the magnitude of tilt is unknown by suitable ratio metric methods.

Angular displacement includes both the orientation and the degree of skew and can be used with the inclination and azimuth of the bottom hole assembly 4 relative to the formation 14 to resolve the inclination and azimuth of the tiltable joint 6 with respect to the formation 14. Inclination and azimuth of the tiltable joint 6 (e.g., bit axis direction 26 of tool face 28 of drill bit 24) can thus be determined without directly measuring the angular displacement between the tiltable joint 6 and bottom hole assembly 4.

Any combination or all of the above steps can be accomplished with a computer. Data on the actuator state (e.g., pressure) obtained through any method outlined above may prove to be noisy. It is appreciated that filtering or other signal conditioning methods can be utilized as desired. Another approach to controlling the signal quality, for example, of the exhaust pressure data, is to develop a signal quality measure. Such a scheme can use measures such as signal-noise ratio, or comparing the magnitude of the signal measured versus a moving average of the signal to determine whether some rapid transient has caused the current sample to be invalid. Logic can be derived (using e.g., fuzzy logic) that will apply weights to the signal based on the quality of the signal such that inaccurate signal data can be ignored and the system reverts to outer loop control.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed is:

1. A method of determining an orientation of a tiltable joint connected to a bottom hole assembly comprising:

providing a plurality of radially disposed actuators driven by a fluid to tilt the tiltable joint;

correlating a known orientation of the tiltable joint with respect to the bottom hole assembly with a set of known exhaust pressures of the plurality of radially disposed actuators;

measuring an exhaust pressure of the fluid from at least one of the plurality of radially disposed actuators to produce a set of exhaust pressures; and comparing the set of exhaust pressures and the correlated set of known exhaust pressures to determine the orientation of the tiltable joint with respect to the bottom hole assembly.

2. The method of claim 1 further comprising:

providing an inclination and azimuth of the bottom hole assembly with respect to a formation; and resolving an inclination and azimuth of the tiltable joint with respect to the formation via the orientation of the tiltable joint with respect to the bottom hole assembly and the inclination and azimuth of the bottom hole assembly with respect to the formation.

3. The method of claim 1 further comprising supplying the fluid from a bore of the bottom hole assembly, wherein the fluid is a drilling fluid.

4. The method of claim 3 further comprising:

measuring at least one of a fluid supply pressure and a fluid return pressure locally to the plurality of radially disposed actuators; and removing any pressure loss associated with the at least one of the fluid supply pressure and the fluid return pressure from the exhaust pressure to produce the set of exhaust pressures.

5. The method of claim 1 wherein the set of known exhaust pressures is a set of known peak exhaust pressures.

6. A method of determining an angular displacement of a tiltable joint connected to a bottom hole assembly comprising:

providing a plurality of radially disposed actuators driven by a fluid to tilt the tiltable joint;

correlating a known angular displacement of the tiltable joint with respect to the bottom hole assembly with a set of known exhaust pressures of the plurality of radially disposed actuators;

measuring an exhaust pressure of the fluid from at least one of the plurality of radially disposed actuators to produce a set of exhaust pressures; and comparing the set of exhaust pressures and the correlated set of known exhaust pressures to determine the angular displacement of the tiltable joint with respect to the bottom hole assembly.

7. The method of claim 6 further comprising:

providing an inclination and azimuth of the bottom hole assembly with respect to a formation; and resolving an inclination and azimuth of the tiltable joint with respect to the formation via the angular displacement of the tiltable joint with respect to the bottom hole assembly and the inclination and azimuth of the bottom hole assembly with respect to the formation.

8. The method of claim 6 further comprising supplying the fluid from a bore of the bottom hole assembly, wherein the fluid is a drilling fluid.

9. The method of claim 8 further comprising:

measuring at least one of a fluid supply pressure and a fluid return pressure locally to the plurality of radially disposed actuators; and removing any pressure loss associated with the at least one of the fluid supply pressure and the fluid return pressure from the exhaust pressure to produce the set of exhaust pressures.

10. The method of claim 6 wherein the set of known exhaust pressures is a set of known peak exhaust pressures.

11. A method of determining an angular displacement of a tiltable joint connected to a bottom hole assembly comprising:

providing a plurality of radially disposed actuators driven by a fluid to tilt the tiltable joint;

measuring an exhaust pressure of the fluid from at least one of the plurality of radially disposed actuators to produce a set of exhaust pressures;

deriving a set of exhaust flow rates from the set of exhaust pressures;

calculating a state of actuation data set for the plurality of radially disposed actuators from the set of exhaust flow rates; and determining the angular displacement of the tiltable joint with respect to the bottom hole assembly from the state of actuation data set of the plurality of radially disposed actuators.

12. The method of claim 11 wherein the step of calculating the state of actuation data set comprises integrating the set of exhaust flow rates over a time interval.

13. The method of claim 11 wherein the step of calculating the state of actuation data set comprises:

integrating the set of exhaust flow rates over a time interval to create a set of volumetric data;

correlating a known volume of discharged fluid with a known actuator displacement; and generating the state of actuation data set via the set of volumetric data and the known volume of discharged fluid correlated with the known actuator displacement.

14. The method of claim 11 further comprising calculating a rate of angular displacement change from the angular displacement.

15. The method of claim 11 further comprising:

providing an inclination and azimuth of the bottom hole assembly with respect to a formation; and resolving an inclination and azimuth of the tiltable joint with respect to the formation via the angular displacement of the tiltable joint with respect to the bottom hole assembly and the inclination and azimuth of the bottom hole assembly with respect to the formation.

16. The method of claim 11 further comprising supplying the fluid from a bore of the bottom hole assembly, wherein the fluid is a drilling fluid.

17. The method of claim 16 further comprising:

measuring at least one of a fluid supply pressure and a fluid return pressure locally to the plurality of radially disposed actuators; and removing any pressure loss associated with the at least one of the fluid supply pressure and the fluid return pressure from the exhaust pressure to produce the set of exhaust pressures.

18. The method of claim 11 wherein the set of known exhaust pressures is a set of known peak exhaust pressures.

* * * * *